US006398645B1

(12) United States Patent
Yoseloff

(10) Patent No.: US 6,398,645 B1
(45) Date of Patent: Jun. 4, 2002

(54) ELECTRONIC VIDEO BINGO WITH MULTI-CARD PLAY ABILITY

(75) Inventor: Mark L. Yoseloff, Henderson, NV (US)

(73) Assignee: Shuffle Master, Inc., Eden Prairie, MN (US)

( * ) Notice: Subject to any disclaimer, the term of this patent is extended or adjusted under 35 U.S.C. 154(b) by 0 days.

(21) Appl. No.: 09/294,500

(22) Filed: Apr. 20, 1999

(51) Int. Cl.[7] ..... A63F 9/24

(52) U.S. Cl. ..... 463/19; 273/269

(58) Field of Search ..... 463/16, 17, 18, 463/19, 20, 21, 22, 12, 13, 25, 26, 27, 29, 30, 31, 40, 41, 42; 273/269, 274, 292, 138.1, 138.2, 143 R, 237

(56) References Cited

U.S. PATENT DOCUMENTS

| | | | | |
|---|---|---|---|---|
| 3,534,963 A | | 10/1970 | Weimer | 273/135 |
| 4,121,830 A | | 10/1978 | Buckley | 273/138 A |
| 4,218,063 A | | 8/1980 | Cooper et al. | 273/237 |
| 4,312,511 A | | 1/1982 | Jullien | 273/237 |
| 4,332,389 A | | 6/1982 | Loyd, Jr. et al. | 273/237 |
| 4,378,940 A | | 4/1983 | Gluz et al. | 273/237 |
| 4,475,157 A | | 10/1984 | Bolan | 364/410 |
| 4,661,906 A | | 4/1987 | DiFrancesco et al. | 364/410 |
| 4,747,600 A | | 5/1988 | Richardson | 273/269 |
| 4,798,387 A | | 1/1989 | Richardson | 273/237 |
| 4,856,787 A | | 8/1989 | Itkis | 273/237 |
| 5,007,649 A | | 4/1991 | Richardson | 273/237 |
| 5,042,818 A | | 8/1991 | Weingardt | 273/292 |
| 5,054,787 A | | 10/1991 | Richardson | 273/369 |
| 5,072,381 A | | 12/1991 | Richardson et al. | 364/410 |
| 5,160,146 A | | 11/1992 | Greer | 273/269 |
| 5,178,395 A | | 1/1993 | Lovell | 273/238 |
| 5,230,514 A | | 7/1993 | Frain | |
| 5,242,163 A | * | 9/1993 | Fulton | 273/269 |
| 5,297,802 A | | 3/1994 | Pocock et al. | 273/439 |
| 5,356,140 A | | 10/1994 | Dabrowski et al. | 273/85 CP |
| 5,393,057 A | * | 2/1995 | Marnell, II | 273/269 |
| 5,482,289 A | | 1/1996 | Weingardt | |
| 5,615,888 A | | 4/1997 | Lofink et al. | 273/292 |
| 5,639,088 A | * | 6/1997 | Schneider et al. | 273/138.2 |
| 5,697,843 A | * | 12/1997 | Manship et al. | 463/20 |
| 5,718,631 A | | 2/1998 | Invencion | 463/19 |
| 5,727,786 A | | 3/1998 | Weingardt | |
| 5,803,808 A | | 9/1998 | Strisower | 463/11 |
| 5,971,849 A | * | 10/1999 | Falciglia | 463/16 |
| 5,980,384 A | * | 11/1999 | Barrie | 463/16 |
| 6,079,711 A | * | 6/2000 | Wei et al. | 273/269 |
| 6,126,542 A | * | 10/2000 | Fier | 463/16 |

* cited by examiner

*Primary Examiner*—Michael O'Neill
(74) *Attorney, Agent, or Firm*—Mark A. Litman & Assoc. P.A.

(57) ABSTRACT

A method of playing a video bingo game comprises providing for a video variant of Bingo in which the player is provided with a multiple number of Bingo Cards on the video screen. The Player may elect to play one or more of the cards displayed on the screen. At least some of the various bingo cards, even if not in elected play by the player, may remain on the screen during the play of the elected cards. The player may play the same amount or different amounts on the individual hands selected, and play of the hands is based upon the same bingo balls drawn.

54 Claims, 2 Drawing Sheets

Bingo Combinations all combinations may be made in any direction

ELECTRONIC VIDEO BINGO WITH MULTI-CARD PLAY ABILITY

BACKGROUND OF THE INVENTION

1. Field of the Invention

The present invention relates to an electronic video game device, specifically to an interactive system using a programmed digital computer for playing bingo with special game playing features.

2. Background of the Art

Bingo is a popular game enjoyed by many people of all ages throughout the world. It is a favorite pastime and one of the most commonly used games for raising funds by various organized groups such as schools, churches and other non-profit organizations. Bingo has also achieved a unique position in the gaming community as a game with a large participating player group. Bingo provides excitement and entertainment to players and enthusiasts, and it is a simple game to understand and play, with players understanding that in parlor or game room bingo, there must always be an eventual winner, which makes the game interesting and attractive to many people.

In the common or traditional version of playing bingo, one or more persons is required to provide the following functions: operate a ball drawing device, select a ball, read and announce the ball's number, show the ball or operate a display apparatus which displays the ball's number, record the selected number, validate a winning card, verify and check the numbers, and finally award a winner. These operator functions are discussed in greater detail below.

The basic elements of a more modernized bingo game may include the following:

(a) pseudo-random number generator or drawing device;

(b) bingo cards;

(c) display apparatus;

(d) audio system;

(e) card validation and verification device; and (f) operator and caller.

The equipment still being used today by large bingo operators to draw numbers is a lot machine or blower unit (i.e., blowing air supporting and moving balls with numbers in a random manner within a selection tank). This blower unit is a large plastic or glass container with Ping-Pong type balls or light plastic balls placed inside the container. Each ball is marked with a number from 1 to 75 (or 1 to 90) and the corresponding bingo letter (e.g., B-1, I-17, etc.). Forced air (e.g., produced by an electric fan) blows the balls to mix them and an operator or an automated selection device draws a ball at random through an opening. The operator will then read the number on the ball and announce the number. The operator or caller has to shout out loudly and clearly so that the players can understand each call. In large bingo halls, an audio amplifier and loud speaker system are used to make this possible. Additionally, in larger bingo parlors, a board is provided on which the numbers drawn are displayed on a board for view by the entire playing audience.

In most homes the drawing device used is a small plastic container with an opening, similar to the one mentioned above. Small balls or chips, each marked with a number and the corresponding bingo letter, are put inside the container. The balls are mixed together manually by shaking or rotating the container. An operator provides a number by drawing out a ball through the opening, one at a time, using his hands. Similarly, the operator will read the number and announce the number to the players.

The use of such mechanical devices is awkward, inconvenient and cumbersome. Several patented devices, such as U.S. Pat. No. 4,218,063 (1978) issued to Cooper, et. al., and U.S. Pat. No. 5,178,395 (1993) issued to Lovell, still largely depend upon the conventional system of drawing numbers. Another serious disadvantage with these mechanical devices is that an operator can defeat the devices by easily manipulating or tampering with the balls or numbers. This could be performed collusively to some particular player's advantage, thus making the game unfair to other players. Since these mechanical devices depend largely on an individual to operate them, these are not reliable from security standpoint.

The standard bingo cards are made of sheets of paper or cardboard on which the numbers are pre-printed. Players use daubers, ink markers, chips or other things to mark or cover the numbers that are called. An example of this is presented in U.S. Pat. No. 5,160,146 (1992) by Greer; which is an improved multiple bingo game sheet. Most standard bingo cards are reusable while others are disposable. Several electronic bingo cards or hand held bingo calculators have been made, such as those disclosed in U.S. Pat. No. 4,378,940 (1983) by Gluz; U.S. Pat. No. 4,475,157 (1984) by Bolan; U.S. Pat. No. 4,661,906 (1987) by Di Francesco et. al. and those patent issued to John Richardson: U.S. Pat. Nos. 4,747,600 (1988); 4,798,387 (1989); and 5,072,381 (1992). These electronic aids allow a single player to manage and play more cards better than using the conventional bingo cards. However, these devices relate only to bingo cards and have no provision for pseudo-random selection of numbers for the game.

The purpose of a display apparatus is to display several items or individual images or pieces of numerical information to the players such as the game number, the last number called, a record of numbers drawn, and the count of numbers called. Other display apparatus also shows the winning game pattern to be formed for a particular game. The apparatus still commonly used today consists of a plurality of display boards all connected to a master controller board. A separate display board is used for each numerical information. One of this type of display apparatus is disclosed in U.S. Pat. No. 4,218,063 (1980) issued to Cooper et. al. The masterboard is a console which includes numbered apertures at the top where Ping-Pong balls are placed. Beneath each aperture is a ball-actuated electrical switch which is turned on whenever a ball is present. The switches operate a display board or flashboard consisting of a plurality of lights with each light illuminating a number. Lovell, U.S. Pat. No. 5,178,395 (1993), made an improvement to the masterboard using light beams with electronic encoding and an LED display board. Both of these references relate only to display apparatus and display only the numbers that are called. Moreover, these apparatus rely on a ball drawing device and depend on an operator to operate both. Such apparatus will be separate, thus, the game requires additional equipment.

Other display apparatus employs a combination of a video camera and a video monitor. The camera is focused on the last ball drawn and the image is displayed on the video monitor. This arrangement is expensive, and displays the last number drawn only.

Another device that is useful in a large bingo hall is audio equipment. The voice of an operator or caller over a loud speaker system is still commonly used today. The announcement by the operator is sometimes not clear enough to be understood by all the players. It should be noted here that the use of an audio synthesizer or electronic sound generator for this purpose is still not popular today.

When the word "bingo" is called by a player to declare a win, there is a need to validate the winning card and verify the numbers in the card in accordance with a predetermined winning pattern. This validation process checks a card if it is entered in a game or not. The most common procedure is to do the validation and checking manually by the operator or a third person. However, some electronic devices have been made to do the validation automatically. One such device is disclosed in U.S. Pat. No. 5,054,787 (1991) issued to Richardson. This validation system requires a plurality of electronic bingo cards, each in communication with a base station or master control board, to be entered manually by the operator before the game starts. Since homes are not so equipped, the practical use of this validation device is limited. This device is used only by large operators and casinos. It is not applicable for home or private use and most household consumers cannot afford it.

Several other electronic devices have been made to automate the playing of bingo games but each has one or more disadvantages; or its application is limited. One of these is U.S. Pat. No. 4,121,830 (1978) issued to Buckley describing a computerized bingo apparatus. This includes an old design to generate pseudo-random numbers and two separate display boards. These display boards show only two items of numerical information; that is, the last number generated and the list of numbers called. The U.S. Pat. No. 4,856,787 (1989) to Itkis, describes an electronic game playing system capable of simultaneously playing poker, keno and bingo. U.S. Pat. No. 4,312,511 (1982) issued to Jullien of Canada describes an electronic bingo system. This is basically a masterboard which still uses Ping-Pong balls to turn on switches. The display board, located at a remote location, is connected to the masterboard by several long cables. This display board contains a plurality of lamps with each lamp illuminating a number. A second LED display shows only the last number drawn. This system is intended for use in large bingo halls. In a similar vein is the U.S. Pat. No. 5,178,395 (1993) to Lovell, which requires an operator to randomly draw balls and place these into a nest which senses the presence of a ball and causes the display of the ball's number. Another electronic bingo game is disclosed in U.S. Pat. No. 4,332,389 (1982) issued to Loyd, et. al. in which a claim to a late bingo can be recalled and verified. It employs five separate display units to show all the numerical information and game pattern required.

A U.S. Pat. No. 5,242,163 (1993) issued to Fulton describes a casino game system for playing bingo and other games within the casino. This system uses electronic cards which are in communication with the casino gaming devices and in turn are electrically connected to a master control station. It is a system that allows a casino player to play at a remote location in the casino. Since most places are not so equipped other than the casino, this system is to be used exclusively in casinos. Another automated bingo System is U.S. Pat. No. 5,297,802 (1993) issued to Pocock et. al. of Canada. This system is a television show which allows a television viewer to play bingo with other viewers. The viewers join the game and place bets by using a touch-tone phone for entering data. One disadvantage of this system is that the viewer is not actually playing a game of bingo, but merely watching and waiting until the game ends. Winners are informed of their winnings through an automatic telephone dialing system. It is a system of mass audience participation and its application is limited to a television game show.

In general, each of the references described herein has one or more of the following disadvantages:

(a) they require use of a mechanical apparatus or a manually operated device for drawing numbers at random;

(b) they depend largely on an individual to operate the device and announce the number;

(c) they require use of a loud speaker system;

(d) they use of one or more display units connected to a master board by means of long cables;

(e) the system or device is often not practical for home use or by small groups of players;

(f) they represent a considerable expense and are largely unaffordable to a household consumer; and (g) they do not provide the player with any game information except for the outcome of the game being played.

U.S. Pat. No. 5,718,631 describes electronic gaming equipment that is applicable mainly for home use, but not limited thereto, which could facilitate the playing of bingo and eliminate most of the manual operating functions. This is accomplished by employing a conventional computer and a standard home television set. The television set is used to provide several Bingo game functions, as a single multi-display apparatus and to announce the numbers. The principal object of that invention is to provide an electronic bingo game device that can be adapted to a standard home television set, and eliminate the need for a dedicated separate display apparatus, the human caller, and additional audio equipment.

The advent of video gaming equipment, particularly computer memory driven video games has added dramatic improvements and variety to games played in casinos. Mechanical bingo games have been known for a long period of time, as represented by U.S. Pat. No. 3,534,963, that apparatus being truly mechanical rather than electronic. U.S. Pat. No. 5,007,649 describes an electronic gaming apparatus in which a number of different players may interact in the play of a single game, including bingo.

In spite of the great potential for variations in games, including bingo, in electronic gaming systems, the industry has not yet taken full advantage of the versatility in the games that is available on electronic equipment. It is of course desirable and advantageous to take advantage of the full ability of electronic systems to play games that could not be easily played in manual or mechanical systems. This variety in gaming play is particularly important in the industry where it is recognized that games tend to have a more limited durability of play, with players seeking additional entertainment value or perceived advantage in the play of differing games.

U.S. Pat. No. 5,356,140 describes a video poker game in which a player is dealt two distinct poker hands and may elect one hand or the other to play, and the other hand is voided. The non-elected hand is erased from the screen and the normal play of a game of poker is continued with the elected hand.

Numerous video games and live casino games include multiple decks in the play of a game, as exemplified in U.S. Pat. Nos. 5,042,818; 5,803,808; and 5,615,888 in which a single game is played, but the cards are selected from multiple decks.

A Bingo-Type game, herein referred to as "Mini-Bingo" is in the public domain. In that Mini-Bingo game, a player attempts to draw numbers (e.g., "Bingo Balls") that correspond to numbers on a displayed card. The game provides a video game player with a single bingo card comprising (for example) a 3×3 bingo card, with (for example) seven different numbers available for each column of 3 in the card. A variety of different payouts (shown in FIGS. 1A–1L) is available to the player. A random set of numbers (e.g., at least 3 and usually at most six) is selected from among the 21 (3 times 7) numbers available for the bingo card, and payouts are provided for obtaining any of the specific payout lines allowed in the play of the game. Ordinarily, squares in the first column are randomly populated with numbers from a set of numbers (e.g., 1, 2 . . . 7). Squares in the second column are randomly populated (except for possibly the center square with a 'free space') with numbers from a second set of numbers )(e.g., 8, 9 . . . 14. Squares in the third column are randomly populated with numbers from a set of numbers (e.g., 15, 16 . . . 21). After depositing from, for example, 1 to 5 coins, the player may select a bingo card or accept a displayed (on the video screen) bingo card (e.g., a previously played bingo card or a new randomly provided bingo card). If a new card is desired, a 'new card' button is pressed from the keyboard on the device. When satisfied with the bingo card, the player hits the Deal/Draw button, which begins a sequence of displaying the drawn bingo balls, usually five numbers. As the bingo balls and numbers are drawn, the appropriate (matched) squares on the bingo card of the player display a color change to indicate a match. The bingo card is evaluated by the software and, if appropriate, a payout is made according to the payout table.

There is still a wide variety of novel games and formats that are available in the play of Bingo-Type games that have not been described or played.

SUMMARY OF THE INVENTION

The present invention provides for a video variant of Bingo in which the player is provided with a multiple number (greater than one, including but not limited to 2, 3, 4, 5, 6, 7, 8, 9, and 10) of Bingo Cards on the video screen. The Player may elect to play one or more of the cards displayed on the screen. At least some of the various cards, even if not in elected play by the player, remain on the screen during the play of the elected cards. The player may play the same amount or different amounts on the individual cards selected, and play of the card is based upon the same bingo balls drawn.

DETAILED DESCRIPTION OF THE INVENTION

Figure 1:
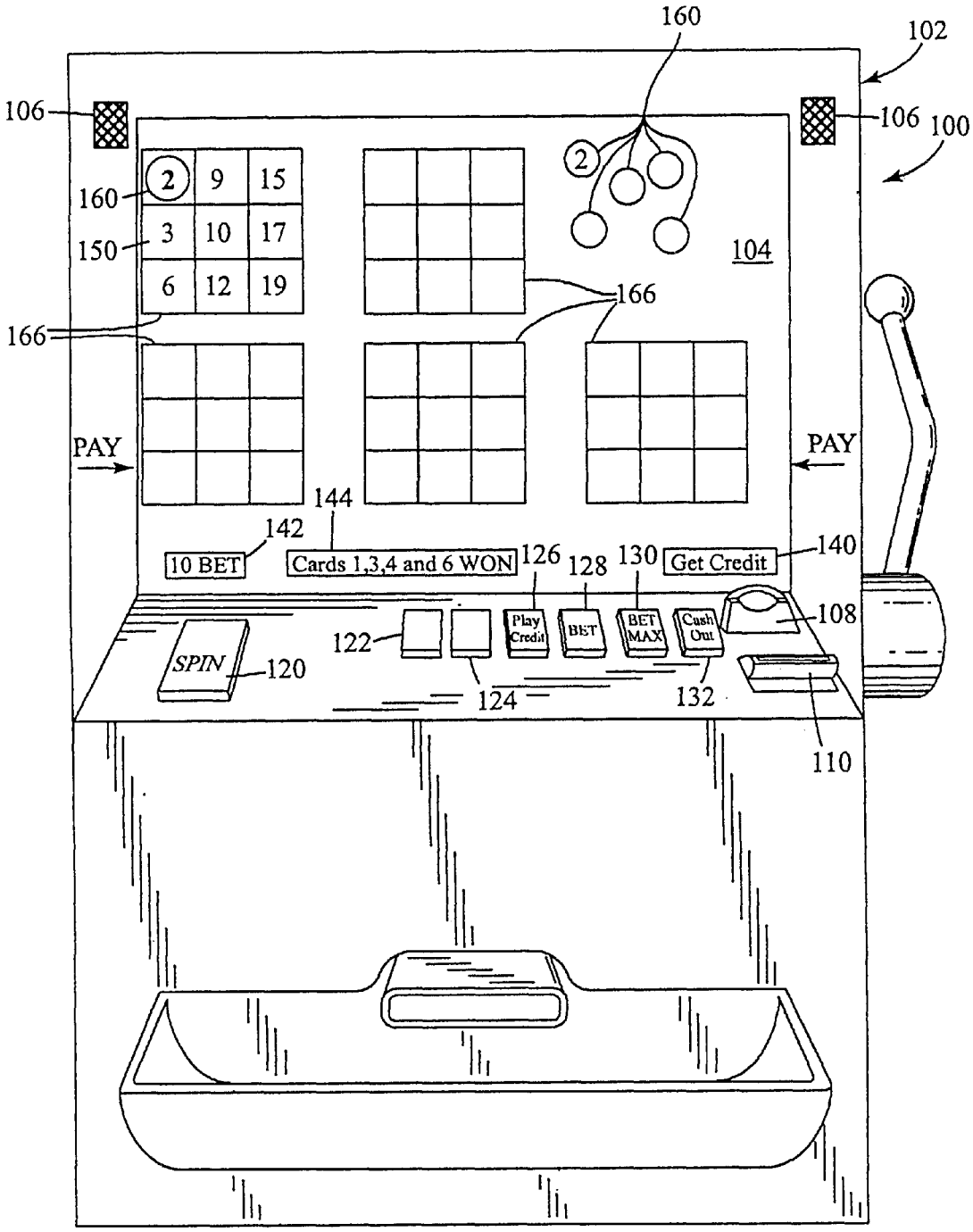
FIG. 1 shows a series of different types of pay lines 1A through 1L that may be used, for example, in individual cards provided for the mini-card version of the Multi-Card Bingo game of the present invention.

The standard game of Bingo provides each player with at least one bingo card with an odd-by-odd number of squares on the card. The most traditional game has 5×5 columns and rows with from 10 to 20 different numbers available in each column (e.g., column B may have numbers 1–15 available, column I may have numbers 15–30 available, column N may have numbers 31–45 available, column G may have numbers 46–60 available, and column O may have numbers 61–75 available, the numbers listed as B-3, I-18, N-42, G-59, and O-72). Each card will have five different numbers listed in each column. It is also very common to have the center square (the third square down in the N column) denoted as a "Free Space." That is, the space is treated as if that particularly numbered space has already been called and filled. In the most common format of Bingo, many different players are present, each player having different cards, and the first player to have numbers called that form a completely filled column, row, or diagonal (or in some cases a complete card or multiple lines or rows) wins the game. The reason for the odd-by-odd (e.g., 3×3, 5×5, 7×7, etc.) number of squares is so that any completed Bingo will travel corner-to-corner on the card, and the Free Space is available for any diagonal Bingo.

For the purpose of this invention, the phrases "bingo numbers" and "bingo balls" are used interchangeably to mean the same thing, i.e., a number that represents one of the symbols or positions on a bingo card, either an actual card, virtual card, or video displayed card . Furthermore, the phrases "generating a random number" and "drawing a ball" have the same generally effective meaning of randomly selecting numbers to be demarcated for play on a player's card(s).

In the play of the present game, a method of playing a video bingo-type game on a video gaming apparatus having a video screen is taught in which game wagers are placed on the outcome of a bingo-type game. The method comprises, in any order:

a) a player viewing at least two different bingo cards on the video screen. All of the numbers on the cards being from within a first set of numbers (e.g., in a mini bingo card from within the set of {1,2, . . . 21, with, for example, numbers 1,2 . . . 7 in column 1; numbers 8,9 . . . 14 in column two; and numbers 15, 16 . . . 21 in column 3});

b) the player selects which of the at least two bingo cards, including up to all of the at least two bingo cards, will be wagered on in the play of the video bingo-type game. The player may use the originally displayed cards, request additional alternative card(s) (on an individual card-by-card basis or with a complete replacement of all or less than all cards), or construct cards with player selected numbers in each square (although without the same number being repeated within a single bingo card).

c) The player wagers on the play of all selected bingo cards. The amount of the wager may be the same or different for each bingo card in the same game, the player making the selection for the amount of wager on each card and/or there being a default to the amount of wager on each card from the previous game or to a default on the same amount on all cards.

d) A significant enticement to increased activity and involvement in players is the fact that it is possible during the play of the game that while both selected bingo cards and non-selected bingo cards are available for viewing on the video screen, the gaming apparatus randomly chooses a second set of numbers from within said first set of numbers, said second set of numbers being smaller than said first set of numbers. The choice or selection/non-selection of bingo cards must of course be made prior to the display of the randomly selected second set of numbers or bingo ball.

e) The apparatus (e.g., software or hardware) compares the second set of numbers to the numbers on each of the selected (and in a preferred embodiment) and the non-selected bingo cards. The matching numbers (between the randomly selected second set of numbers and the numbers on the bingo cards) on at least the selected bingo cards are identified and recognized (e.g., displayed) by the apparatus on both selected and non-selected hands. The apparatus then awards credits or money to the player for achieving any payout lines on any of the selected bingo cards.

The method may be played wherein any numbers on selected bingo cards matching the second set of numbers are illuminated differently from numbers on selected bingo cards that are not within the second set of numbers. The method may be played wherein the second set of numbers are displayed separately on said video screen. The method may be played wherein the different illumination of matching numbers is a highlighting of the matching numbers or backlighting of the matching numbers comprising a different color or greater amplitude of color as compared to a color used to display numbers on a bingo card that are not matching numbers.

The method may be played wherein randomly selected numbers are compared to numbers on non-selected bingo cards. The method may be played wherein randomly selected numbers that match numbers on non-selected bingo cards are identified on the non-selected bingo cards. The identification of randomly selected numbers on the non-selected bingo cards may comprise using a different color or greater amplitude of color as compared to a color used to display numbers on the non-selected bingo card that are not matching numbers. The different illumination of matching numbers in selected cards may comprise a highlighting of the matching numbers or backlighting of the matching numbers on selected bingo cards that comprises a different color or greater amplitude of color as compared to a color used to display numbers on a bingo card that are not matching numbers on the selected bingo cards. The highlighting of matching numbers on selected bingo cards may be different from the method of highlighting matching numbers on non-selected bingo cards. A different color may used to highlight matching numbers on selected bingo cards than the color used to highlight matching numbers on non-selected bingo cards. For example, the original numbers in squares on the bingo cards displayed on the screen may be black-on-white, the highlighted matching numbers on selected cards may be green, and the highlighted matching numbers on non-selected cards may be red. Special indicators may be provided to assure that a player is aware of the specific bingo cards selected or non-selected by her/him. For example, selected cards may be highlighted with different colors, color intensity, color amplitude, shading of the card, intensification of borders or frames of the cards, flashing/steady signals adjacent each selected/non-selected card to distinguish them, etc. The number of different bingo cards may be, for example, selected from the number consisting of 2, 3, 4, 5, 6, 7, 8, 9 and 10 or more. The bingo cards are provided on the video screen for selection by a player in advance of placing the wager. However, it is possible, although less preferred, to have a player select a number of bingo cards to be played, place the wager, and then have the cards displayed. The method may be practiced with both conventional rules of bingo and with advances made in the play of bingo. For example, at least some or all of the different bingo cards may be provided with a free space in the center. The method is particularly desirable and space efficient (on the video screen) wherein each bingo card comprises a 3×3 square mini-bingo card.

Figure 2:
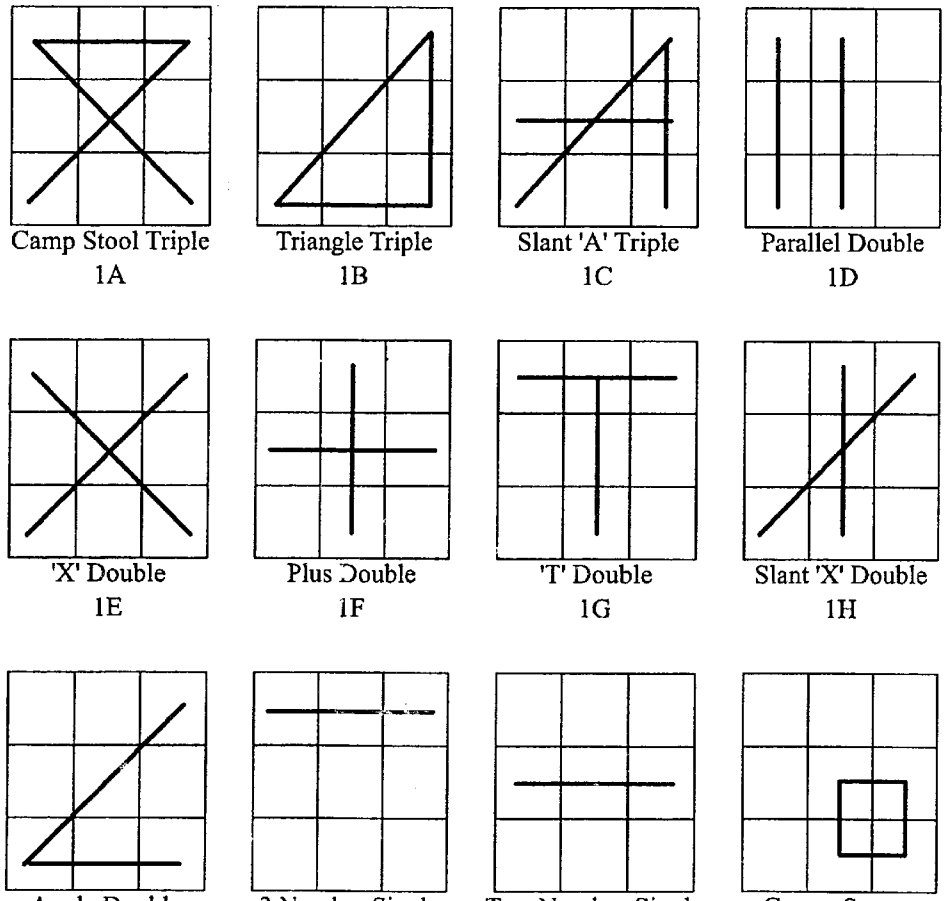
FIG. 2 shows a video gaming machine with five different cards available on it, and the bingo balls used for play of games with some of the cards elected by a player.

Similar configurations and formats could be established in a 5×5 square video Bingo game, but with the frequencies of wins, numbers of specially marked Bingo balls, particular orientations of wins, and the like varied to properly fit the differing format of the game. FIG. 2 is a perspective view illustrating an electronic video apparatus system 100 according to one aspect of the present invention. The video game system 100 includes a computer (not shown, but within a housing 102, a standard video screen 104, optionally speakers 106, a coin slot 108, credit card or paper money slot 110 and play buttons 120, 122, 124, 126, 128, 130, and 132. Credit indicator 140, bet indicator 142, and another optional indicator 144 are shown. The optional indicator may, for example, display each Bingo ball as selected or identify the payout for that game, or display any other desirable feature or information.

In the embodiment illustrated in FIG. 2, the display monitor 104 is shown as displaying only the player Bingo card for simplicity. The numbers in the nine frames (e.g., 150) are shown as the finally selected numbers (e.g., number "2" 160) used by the player. The number 2 (160) is shown with a special marking feature, indicating both the selection of that number and the presence of that number within the second set of balls 164. Five game boards 166 are shown. The video game playing system is made up of conventional parts which are interconnected to form the system. The read-only memory may include a boot program, basic input-output, programming language, game program, printer drivers and operating systems which control the system through their interpretation by a CPU and define the video game playing system. The CPU may be responsive to an operating system and game defining programs stored in the read-only memory. The CPU also stores temporary results in the random-access memory during the normal operation of the system. The CPU may also receive time-of-day and day-of-year information from a clock. The CPU uses a controller to receive input from the panel with play buttons 120–132 thereon, which is used by a player to control the operation of the game playing system. The game defining programs stored in the read-only memory include routines for displaying game progress and results on the monitor, and optionally for producing audio output through the speakers. For example, a synthesized voice is used in one embodiment to announce bingo numbers. The CPU may use a video board and a sound board to control the video and sound.

A person having an ordinary level of skill in the art will understand that the following description defines a relationship between the computer execution of the steps of the main program, including the steps of the game program, a system operator's use of the control buttons and the game players' response to the displayed information on the video screen. In this context, the following description defines an electronic video bingo game.

The video gaming device or apparatus on which the method may be practiced includes a video gaming apparatus programmed for viewing at least two simultaneously occurring wagering games, the video gaming apparatus comprising a console, at least one video display, a plurality of player controls, and a system for receiving a wager. The at least one video display, player controls, and device for receiving a wager are usually mounted on the console. A computer is preferably in communication with the plurality of player controls, video monitor and system for receiving a wager; wherein the computer is programmed to:

a) simultaneously display at least two wagering games on the at least one video monitor;

b) provide a player with an opportunity to place a wager on at least one of the simultaneously displayed games, and c) provide a visual display for all winning outcomes for each of the at least two wagering games in response to a player placing a wager and manipulating the player controls regardless of whether a bet has been placed on all of the simultaneously displayed at least two wagering games. The apparatus may provide each of the simultaneously displayed at least two wagering games as a like game. The apparatus may provide each of the simultaneously displayed at least two wagering games to employ a set of game symbols, wherein a plurality of game symbols are randomly selected for play, and wherein the same randomly selected symbols are used to resolve outcomes of at least two of the simultaneously displayed at least two wagering games. The apparatus may have each of the simultaneously displayed at least two wagering games comprising bingo. The apparatus may have each of the simultaneously displayed at least two wagering games comprise bingo wherein the bingo game includes:

providing the player with at least two bingo cards, each card bearing a plurality of symbols;

drawing a plurality of balls from a first set of game balls comprising symbols, without replacement of game balls, to define a second set of symbols;

comparing the symbols of the second set of symbols to the symbols on each card, regardless of whether or not each card is being played;

providing a visual display of all winning outcomes on each card, regardless of whether or not each card is being played; and awarding a payout for each predetermined winning outcome on each card being played.

The apparatus may have a symbol on each ball sequentially drawn from the first set of game balls and then have the symbols compared to symbols on each game card as each ball is drawn. The apparatus may have the first set of balls comprise thirty balls numbered sequentially between 1 and 30. Altering the number of possible symbols in each column or on each card, and the total number of symbols in the first set, and the number of symbols in the second set alters the probabilities of individual numbers being matched and the probability of predetermined winning combinations occurring upon random selection of the second set according to standard principles of probability and outcome. The apparatus may, as a preferred example, display and use formats where each game card has three vertical columns, the first set of game balls is subdivided into three separate subsets of balls, and balls from a first subset are used to match symbols in a first column, balls from a second subset are used to match symbols in a second column, and balls from a third subset are used to match symbols in a third column.

The apparatus may, for example, use symbols comprising numbers and said first subset comprises balls numbered from 1 to 10, said second subset comprises balls numbered from 11 to 20, and said third subset comprises balls numbered from 21 to 30. The apparatus in a preferred practice provides the second set of balls as five randomly selected balls. The apparatus may determine each simultaneous game outcome from the random selection of a second set of balls from a first set of balls without replacement of any balls as they are selected from the first set. The apparatus may provide the at least two simultaneously displayed games as different games. The apparatus may alternatively provide the at least two simultaneously displayed games as identical games. The apparatus may have the at least two simultaneously displayed games comprise one or more games selected from the group consisting of card games, dice games and number matching games. The apparatus may have the at least two simultaneously displayed games comprise cards games selected from the group consisting of any variant of poker or ranking of hands, such as video poker, Caribbean Stud Poker (R), Let It Ride (R) Poker and Pai Gow Poker or Blackjack. The apparatus may provide at least one of the at least two simultaneously displayed games as a dice game such as bar dice poker or craps. The apparatus may provide at least one of the at least two simultaneously displayed games as selected from the group consisting of keno, bingo and lottery games or a video reel slot game. The apparatus may also comprise a second video monitor. The apparatus may then have a first game displayed on the first monitor and a second game displayed on the second monitor. The apparatus may have each visual display achieved by at least one of the group selected from hilighting, backlighting, color change, variation in light intensity, outlining or association with a symbol indicative of a winning outcome (e.g., a wreath, crown, check, "X" mark, framing of the square, etc.). The visual display may be a pay line drawn through or across or around the individual squares that add up to a winning combination or orientation of symbols. The pay line may comprise words that are created by the symbols, overwritten or written on the screen, symbols or cards. The apparatus may preferably use a first set of balls consisting of twenty-one balls numbered 1 through 21 and a second set of balls consisting of eighteen randomly selected balls, wherein the predetermined winning outcome comprises all symbols on at least one card matching numbers on balls from the second set. In this particular format of play, an objective of the "cover-all" play is to have every space on a card filled by matching the symbols from the randomly drawn second set of symbols. Payouts are awarded on the basis of how few numbers must be selected in the drawing of the second set of symbols to completely fill an individual bingo card or create a winning combination. The fewer the number of balls selected in the second set, the relatively higher the payout. The apparatus preferably provides each card with a centrally located free space, as wherein each card has three vertical columns consisting of three symbols each, and wherein a symbol in a central column is a free space. The apparatus may, for example, provide bingo payouts approximately as follows:

| Outcome | Payout |
|---|---|
| Camp Stool Triple | 10,000 |
| Triangle Triple | 5,000 |
| Slant "A" Triple | 2,500 |
| Parallel Double | 1,250 |
| "X" Double | 500 |
| Plus Double | 500 |
| "T" Double | 200 |
| Slant "X" Double | 75 |
| Angle Double | 50 |
| 3 Number Single | 40 |
| Two Number Single | 25 |
| Corner Square | 10 |

Any other scale of payout may be used, usually selecting a payout scale that provides the house with a winning percentage, yet offers players a reasonable short-term chance of winning, such as the players overall percentage win on all bets placed being no less than 90% and no more than 99.9%.

The apparatus may allow a player an option of placing unequal bets on each of said at least two simultaneously played games. The apparatus may, for example, provide two, three, four, five, six, seven, eight, nine or ten or more cards and the player has an option of playing every displayed card simultaneously. The player may have an option of placing equal bets on each of said simultaneously displayed games. Rule Changes That Alter the Player's Odds of Winning:

1) With a player playing more than one bingo card per game, there will be an increase in the number of wins while playing, even though the percentage of wins and pay-back is not altered in the play of each card.

Rule Changes That Offer the Potential for Increased Player Participation:

One of the main objectives on varying rules and formats for video games is to keep the level of interest of a player at a high level. Most players therefore enjoy greater variety and selection and choice in the play of the game, particularly where they feel they are taking an active and constructive part in selection and thereby increasing their chance of winning by their skill.

1) By allowing players to see a number of cards, they are allowed to choose amongst cards and decide which combinations of numbers appear to be more favorable, whether the choice is based upon reason or superstition.

2) Many players will track numbers, looking for numbers that appear to repeat frequently or that are not selected by a particular machine. Players will then look for cards with these 'hot' numbers or avoid cards with the 'cold' numbers.

3) Players will watch cards that are not selected in one game, and when seeing that certain cards appear to be having greater luck than their selected cards, shift from card to card or include more cards in their play.

4) Generally the activity of watching more cards, even when those cards are not selected and are therefore not in play, increases the interest level of a player and is likely to extend the length of time the player will enjoy the gaming activity.

Another way of describing a practice within the scope of the present invention is as a method of playing a video bingo-type game comprising:

a) providing a selection of at least two virtual bingo play cards, each virtual bingo play card having alphanumerics in frames in columns and rows, the alphanumerics in said columns and rows being less than all alphanumerics available for placement within frames;

b) allowing the player to select one or more than one virtual bingo play card for wagering, and placing wagers on each virtual bingo play card selected for play in the bingo type game;

c) randomly selecting a number of alphanumerics from a set of alphanumerics including all of the alphanumerics available for placement within frames;

d) identifying alphanumerics that match alphanumerics on at least each of the selected virtual bingo play cards;

e) if the number, order and/or position of alphanumerics randomly selected has a predetermined level of correspondence to a number, order and/or position for alphanumerics in a selected virtual bingo play card, then an award or credit is provided to the player. Again, it is desirable to have the non-selected bingo cards viewable during play of the game and to have the matching alphanumerics on the non-selected cards highlighted to indicate the relative success of the non-selected virtual bingo play cards.

As previously noted, under certain circumstances it is desirable to practice a method within the scope of the present invention where there are either 3×3 frames or 5×5 frames or 7×7 frames, each frame displaying alphanumerics. The highlighting of matched alphanumerics may comprise, as described above, a special characterization selected from the group consisting of coloration, color intensity, additional figures, characters (animated or not), symbols, shading, size variation, and animation of alphanumerics.

The accompanying Table 1 shows the payout schedule for Multi Card Mini Bingo™, which is a preferred mode of play on a 3×3 mini bingo card with seven numbers available on each column for play in each card of the Multi-Card Bingo game of the present invention.

FIG. 1 (A through L) shows a selection of various Bingo Combinations that may be used to provide payouts for play of each mini bingo player card. Any other particular combination of filled or unfilled squares (e.g., a card with no squares filled may receive a complete or partial refund of a wager) may be used, including other non-linear, or non-single linear arrangements (e.g., V-angled arrangements or non-continuous or non-contiguous spaces) or scatter pay. Another embodiment, prizes may be awarded for cards with no matches or with unfilled squares arranged in a shape shown in FIG. 1.

In another embodiment of the invention, the screen may contain a frequency board, showing the frequency of numbers selected over a specific number of hands, including but not limited to the last 2, 3, 4, 5 10, 20 or total hands for the day. This would give players an opportunity to attempt to construct boards with 'hot' numbers. This is particularly true where a player may construct each bingo card or one or more bingo cards by inserting specific numbers into each square on the cards, which is an optional play on the game. This would be done by providing keys on the video apparatus allowing the player to identify individual cards shown (which might be desirable in conventional play), selecting individual squares in each card, and selecting and entering individual numbers for each square on each card. The games may be linked together with other machines to form a progressive jackpot. Other embodiments will be readily perceived and understood by those of ordinary skill in the art and the absence of a literal description within this patent does not imply that such alternatives are excluded from the scope of the present invention.

What is claimed is:

1. A method of playing a wagering game on a video gaming apparatus having at least one video screen in which game wagers are placed on the outcome of a game displayed on the video screen, the method comprising:

a) a player viewing at least two games on at least one of the at least one video screens, b) the player selecting which of the at least two games, including at least one, at least one but fewer than all, and up to all of the at least two games, will be wagered on in the play of the video bingo-type game, c) the player wagering on the play of all selected bingo cards, d) while all of the selected games and non-selected games are available for viewing on the at least one video screen, the gaming apparatus plays a game which would have gaming consequences on both selected and non-selected games, and e) awarding credits or money to the player for achieving any payout lines on any of the selected games.

2. A method of playing a bingo-type wagering game on a video gaming apparatus having at least one video screen in which game wagers are placed on the outcome of a bingo-type game displayed on the at least one video screen, the method comprising:

a) a player viewing at least two different bingo cards with all symbols on the cards being from within a first set of symbols arranged in columns and rows, b) the player selecting which of the at least two bingo-type games, including at least one, at least one but less than all, and up to all of the at least two bingo cards, will be wagered on in the play of the video gaming apparatus, c) the player wagering on the play of all selected bingo-type games from said at least two bingo-type games, d) while all selected bingo-type games and non-selected bingo-type games are available for viewing on the at least one video screen, the gaming apparatus randomly chooses a second set of symbols from within said first set of numbers, said second set of numbers being smaller than said first set of symbols, and e) awarding credits or money to the player for achieving any payout consequences on any of the selected bingo-type games.

3. The method of claim 2 wherein any numbers on selected bingo cards matching the second set of numbers are illuminated differently from numbers on selected bingo cards that are not within said second set of numbers.

4. The method of claim 3 wherein the second set of numbers are displayed separately on said video screen.

5. The method of claim 3 wherein the different illumination of matching numbers is a highlighting of the matching numbers or backlighting of the matching numbers comprising a different color or greater amplitude of color as compared to a color used to display numbers on a bingo card that are not matching numbers.

6. The method of claim 2 wherein randomly selected numbers are compared to numbers on non-selected bingo cards.

7. The method of claim 6 wherein randomly selected numbers that match numbers on non-selected bingo cards are identified on the non-selected bingo cards.

8. The method of claim 7 wherein the identification of randomly selected numbers on the non-selected bingo cards comprises using a different color or greater amplitude of color as compared to a color used to display numbers on the non-selected bingo card that are not matching numbers.

9. The method of claim 8 wherein the method of highlighting matching numbers on selected bingo cards is different from the method of highlighting matching numbers on non-selected bingo cards.

10. The method of claim 9 wherein a different color is used to highlight matching numbers on selected bingo cards than the color used to highlight matching numbers on non-selected bingo cards.

11. The method of claim 2 wherein a number of different bingo cards selected from the number consisting of 2, 3, 4, 5, 6, 7, 8, 9 and 10 are provided on the at least one video screen for selection by a player.

12. The method of claim 3 wherein a number of different bingo cards selected from the number consisting of 2, 3, 4, 5, 6, 7, 8, 9 and 10 are provided on the at least one video screen for selection by a player.

13. The method of claim 4 wherein a number of different bingo cards selected from the number consisting of 2, 3, 4, 5, 6, 7, 8, 9 and 10 are provided on the at least one video screen for selection by a player.

14. The method of claim 5 wherein a number of different bingo cards selected from the number consisting of 2, 3, 4, 5, 6, 7, 8, 9 and 10 are provided on the at least one video screen for selection by a player.

15. The method of claim 6 wherein a number of different bingo cards selected from the number consisting of 2, 3, 4, 5, 6, 7, 8, 9 and 10 are provided on the at least one video screen for selection by a player.

16. The method of claim 7 wherein a number of different bingo cards selected from the number consisting of 2, 3, 4, 5, 6, 7, 8, 9 and 10 are provided on the at least one video screen for selection by a player.

17. The method of claim 12 wherein at least some of the different bingo cards are provided with a free space in the center.

18. The method of claim 2 wherein each bingo card comprises a 3×3 square mini-bingo card.

19. The method of claim 9 wherein each bingo card comprises a 3×3 square mini-bingo card.

20. The method of claim 2 wherein each of the simultaneously displayed at least two gering games comprises bingo.

21. A video gaming apparatus programmed for viewing at least two simultaneously occurring wagering games, the video wagering apparatus comprising:

a console, at least one video monitor, a plurality of player controls, a system for receiving a wager, wherein at least one video display, player controls, and device for receiving a wager are mounted on the console; and a computer in communication with the plurality of player controls, video monitor and system for receiving a wager, wherein the computer is programmed to:

a) simultaneously display at least two wagering games on the at least one video monitor;

b) provide a player with an option to place a wager on a number of wagering games selected from the group consisting of at least one of the simultaneously displayed games, at least one but less than all of the simultaneously displayed games, and all of the simultaneously displayed games and c) provide a visual display for all winning outcomes for each of the at least two wagering games in response to a player placing a wager and manipulating the player controls regardless of whether a bet has been placed on all the simultaneously displayed at least two wagering games.

22. The apparatus of claim 21 wherein each of the simultaneously displayed at least two wagering games is a like game.

23. The apparatus of claim 21 wherein the apparatus is able to indicate game results for the non-selected games.

24. The apparatus of claim 21 wherein each of the simultaneously displayed at least two wagering games comprises bingo, and the bingo game includes:

providing the player with at least two bingo cards, each card bearing a plurality of symbols;

drawing a plurality of balls from a first set of game balls comprising symbols, without replacement of game balls, to define a second set of symbols;

comparing the symbols of the second set of symbols to the symbols on each card, regardless of whether or not each card is being played;

providing a visual display of all winning outcomes on each card, regardless of whether or not each card is being played; and awarding a payout for each predetermined wining outcome on each card being played.

25. The apparatus of claim 24 wherein each symbol on each ball is sequentially drawn from the first set of game balls and is compared to symbols on each game card as each ball is drawn.

26. The apparatus of claim 24 wherein the first set of balls comprises thirty balls numbered sequentially between 1 and 30.

27. The apparatus of claim 24 wherein each game card has three vertical columns, the first set of game balls is subdivided into three separate subsets of balls, and:

balls from a first subset are used to match symbols in a first column, balls from a second subset are used to match symbols in a second column, and balls from a third subset are used to match symbols in a third column.

28. The apparatus of claim 27 wherein said symbols comprise numbers and said first subset comprises balls numbered from 1 to 10, said second subset comprises balls numbered from 11 to 20, and said third subset comprises balls numbered from 21 to 30.

29. The apparatus of claim 8 wherein the second set of balls consists of five randomly selected balls.

30. The apparatus of claim 24 wherein each simultaneous game outcome is determined by the random selection of a second set of balls from a first set of balls without replacement of any balls.

31. The apparatus of claim 21 wherein the at least two simultaneously displayed games are different games.

32. The apparatus of claim 21 wherein the at least two simultaneously displayed games are identical games.

33. The apparatus of claim 21 wherein the at least two simultaneously displayed games comprise one or more games selected from the group consisting of card games, dice games and number matching games.

34. The apparatus of claim 33 wherein the at least two simultaneously displayed games comprise cards games selected from the group consisting of video poker, Caribbean Stud Poker, Let It Ride Poker and blackjack.

35. The apparatus of claim 33 wherein at least one of the at least two simultaneously displayed games comprises craps.

36. The apparatus of claim 33 wherein at least one of the at least two simultaneously displayed games is selected from the group consisting of keno, bingo and lottery games.

37. The apparatus of claim 33 wherein at least one of the at least two simultaneously displayed games comprises a video reel slot game.

38. The apparatus of claim 21 comprising a second video monitor.

39. The apparatus of claim 33 wherein a first game is displayed on the first monitor and a second game is displayed on the second monitor.

40. The apparatus of claim 21 wherein each visual display is achieved by at least one of the group selected from hilighting, backlighting, color change, variation in light intensity, outlining or association with a symbol indicative of a winning outcome.

41. The apparatus of claim 40 wherein the visual display comprises a pay line.

42. The apparatus of claim 41 wherein the visual display that indicates a winning play comprises words.

43. The apparatus of claim 24 wherein the first set of balls consists of twenty-one balls numbered 1 through 21 and the second set of balls consists of eighteen randomly selected balls.

44. The apparatus of claim 24 wherein the predetermined winning outcome comprises all symbols on at least one card matching numbers on balls from the second set.

45. The apparatus of claim 24 wherein each card has a centrally located free space.

46. Apparatus of claim 44 wherein each card has three vertical columns consisting of three symbols each, and wherein a symbol in a central column is a free space.

47. The apparatus of claim 24 wherein payouts are approximately as follows:

| Outcome | Payout |
|---|---|
| Camp Stool Triple | 10,000 |
| Triangle Triple | 5,000 |
| Slant "A" Triple | 2,500 |
| Parallel Double | 1,250 |
| "X" Double | 500 |
| Plus Double | 500 |
| "T" Double | 200 |
| Slant "X" Double | 75 |
| Angle Double | 50 |
| 3 Number Single | 40 |
| Two Number Single | 25 |
| Corner Square | 10 |

48. The apparatus of claim 24 wherein a player has an option of placing unequal bets on each of said at least two simultaneously played games.

49. The apparatus of claim 24 wherein six cards are provided and the player has an option of playing every displayed card simultaneously.

50. The apparatus of claim 49 wherein the player has an option of placing equal bets on each of said simultaneously displayed games.

51. A method of playing a wagering game on a video gaming apparatus having at least one video screen in which game wagers are placed on the outcome of a game displayed on the video screen, the method comprising:

a) a player viewing at least two games on at least one of the at least one video screens, b) the player selecting which of the at least two games, including at least one, at least one but fewer than all, and up to all of the at least two games, will be wagered on in the play of the video bingo-type game, c) the player wagering on the play of all selected bingo cards, d) while all of the selected games and non-selected games are available for viewing on the at least one video screen, the gaming apparatus plays a game which would have gaming consequences on both selected and non-selected games, and e) awarding credits or money to the player for achieving any payout lines on any of the selected games, wherein less than all of said at least two games are selected.

52. A method of playing a bingo-type wagering game on a video gaming apparatus having at least one video screen in which game wagers are placed on the outcome of a bingo-type game displayed on the at least one video screen, the method comprising:

a) a player viewing at least two different bingo cards with all symbols on the cards being from within a first set of symbols arranged in columns and rows, b) the player selecting which of the at least two bingo-type games, including at least one, at least one but less than all, and up to all of the at least two bingo cards, will be wagered on in the play of the video gaming apparatus, c) the player wagering on the play of all selected bingo-type games from said at least two bingo-type games, d) while all selected bingo-type games and non-selected bingo-type games are available for viewing on the at least one video screen, the gaming apparatus randomly chooses a second set of symbols from within said first set of numbers, said second set of numbers being smaller than said first set of symbols, and e) awarding credits or money to the player for achieving any payout consequences on any of the selected bingo-type games wherein less than all of said at least two games are selected.

53. The method of claim 51 wherein game results are indicated for the non-selected games at the time that credits or money are awarded.

54. The method of claim 52 wherein game results are indicated for the non-selected games at the time that credits or money arc awarded.

* * * * *